US010539274B2

(12) United States Patent
Miwa et al.

(10) Patent No.: US 10,539,274 B2
(45) Date of Patent: Jan. 21, 2020

(54) LIGHT EMITTING DEVICE

(71) Applicant: TOYODA GOSEI CO., LTD., Kiyosu-shi (JP)

(72) Inventors: Tomohiro Miwa, Kiyosu (JP); Kazuhiro Sakai, Kiyosu (JP); Shota Shimonishi, Kiyosu (JP); Shigeo Takeda, Kiyosu (JP)

(73) Assignee: TOYODA GOSEI CO., LTD., Kiyosu-Shi, Aichi-Ken (JP)

( * ) Notice: Subject to any disclaimer, the term of this patent is extended or adjusted under 35 U.S.C. 154(b) by 425 days.

(21) Appl. No.: 14/937,470

(22) Filed: Nov. 10, 2015

(65) Prior Publication Data

US 2016/0131313 A1 May 12, 2016

(30) Foreign Application Priority Data

Nov. 11, 2014 (JP) ..... 2014-229269

(51) Int. Cl.

| | |
|---|---|
| ***F21K 9/60*** | (2016.01) |
| ***F21Y 113/13*** | (2016.01) |
| ***F21Y 115/10*** | (2016.01) |
| ***F21Y 105/10*** | (2016.01) |

(52) U.S. Cl.

CPC ..... *F21K 9/60* (2016.08); *F21Y 2105/10* (2016.08); *F21Y 2113/13* (2016.08); *F21Y 2115/10* (2016.08)

(58) Field of Classification Search

CPC ..... F21K 9/00; F21K 9/60; F21K 9/64; F21K 9/66; F21K 9/68; F21L 14/023; F21L 4/027; F21V 23/001; F21V 23/003; F21Y 2103/10; F21Y 2105/10; F21Y 2105/12; F21Y 2113/13; F21Y 2113/10; F21Y 2115/10; H01L 2224/48091; H01L 2224/48137; H01L 33/02

See application file for complete search history.

(56) References Cited

U.S. PATENT DOCUMENTS 7,204,607 B2 * 4/2007 Yano ..... F21K 9/00 352/235
7,804,162 B2 * 9/2010 Wang ..... C09K 11/7787 257/678

(Continued)

FOREIGN PATENT DOCUMENTS

JP 2005-136006 A 5/2005
JP 2013-051375 A 3/2013

(Continued)

OTHER PUBLICATIONS

Japanese Office Action dated Sep. 19, 2017 in Japanese Application No. 2014-229269 with an English translation thereof.

*Primary Examiner* — William N Harris
(74) *Attorney, Agent, or Firm* — McGinn IP Law Group, PLLC

(57) ABSTRACT

A light emitting device includes a plurality of LED strings connected in parallel, wherein: each of the LED strings includes a plurality of LED chips connected in series to each other; in the LED string, ultraviolet light LED chips and blue LED chips or violet LED chips and blue LED chips are connected in series to each other; and the number of the ultraviolet light LED chips or the number of the violet LED chips is the same as the number of the blue LED chips in each of the plurality of LED strings.

16 Claims, 4 Drawing Sheets

(56) References Cited

U.S. PATENT DOCUMENTS

| | | | | |
|---|---|---|---|---|
| 8,833,982 | B2 * | 9/2014 | Funakubo | F21V 21/00 313/46 |
| 8,860,072 | B2 * | 10/2014 | An | H01L 33/08 257/100 |
| 9,209,354 | B2 * | 12/2015 | Hussell | H01L 25/0753 |
| 9,287,475 | B2 * | 3/2016 | Andrews | H01L 33/60 |
| 9,735,133 | B2 * | 8/2017 | Agatani | H01L 25/0753 |
| D823,492 | S * | 7/2018 | Welch | D26/1 |
| 2004/0218387 | A1 * | 11/2004 | Gerlach | F21K 9/00 362/231 |
| 2005/0057929 | A1 * | 3/2005 | Yano | F21K 9/00 362/240 |
| 2007/0041185 | A1 * | 2/2007 | Yatsuda | F21K 9/00 362/231 |
| 2010/0207134 | A1 * | 8/2010 | Tanaka | F21K 9/00 257/89 |
| 2011/0012143 | A1 * | 1/2011 | Yuan | H05B 33/0821 257/91 |
| 2011/0273880 | A1 * | 11/2011 | Sanpei | F21V 31/04 362/235 |
| 2012/0193651 | A1 * | 8/2012 | Edmond | H01L 25/0753 257/88 |
| 2013/0002167 | A1 * | 1/2013 | Van De Ven | H05B 33/0815 315/297 |
| 2015/0016109 | A1 * | 1/2015 | Ogata | H01L 41/047 362/249.02 |

FOREIGN PATENT DOCUMENTS

| | | | |
|---|---|---|---|
| JP | 2013/120812 | A | 6/2013 |
| JP | 2014-143307 | A | 8/2014 |
| JP | 2015-165456 | A | 9/2015 |

* cited by examiner

LIGHT EMITTING DEVICE

CROSS-REFERENCE TO RELATED APPLICATION(S)

This application is based upon and claims the benefit of priority from Japanese Patent Application No. 2014-229269, filed on Nov. 11, 2014, the entire contents of which are incorporated herein by reference.

BACKGROUND

1. Field of the Invention

The present invention relates to a light emitting device, particularly to the light emitting device in which a plurality of light emitting diode (LED) chips is connected in series to each other so as to form an LED string, a plurality of LED strings is connected in parallel to each other, and an ultraviolet light LED chip or a violet LED chip and a blue LED chip are mixed.

2. Description of the Related Art

JP-A-2014-143307 discloses a light emitting module which includes a plurality of long light emitting portions arranged on a board. In each of the plurality of light emitting portions, a plurality of sets of light emitting portions which have different color temperatures and are adjacent to each other is included. In order to cause the light emitting portions to have different color temperatures, a ratio of phosphors for colors mixed in a wavelength conversion member included in one light emitting portion is caused to be different from that in another light emitting portion.

JP-A-2005-136006 discloses a light emitting device including an ultraviolet light LED chip and a light color conversion member which converts ultraviolet rays emitted by the ultraviolet light LED chip into white light. In JP-A-2005-136006, the light emitting device further includes visible LED chips which emit light in the visible range, in addition to the ultraviolet light LED chip. The visible LED chips are at least one of a blue LED, a green LED, and a red LED.

If white clothes are irradiated with ultraviolet light, an effect of causing the white color of the clothes to be shown more beautifully is obtained. However, as disclosed in JP-A-2005-136006, in the light emitting device having a combination in which the ultraviolet light LED chip and the light color conversion member are combined, since visualization of the ultraviolet light LED chip can hardly be sensed, there is a defect in that effective use of leaked ultraviolet light as the visible light is impossible and luminous efficiency is degraded. Meanwhile, a light emitting device including a blue LED chip and a light color conversion member which converts blue light emitted by the blue LED chip into white light has been used more widely than before. However, in the light emitting device having a combination of the blue LED chip and the light color conversion member, since there is an advantage of high luminous efficiency, but the application of ultraviolet light is impossible, there is a defect in that the effect of causing the white color of clothes to be shown beautifully is not obtained. Thus, if the blue LED chip is included in addition to the ultraviolet light LED chip, as disclosed in JP-A-2005-136006, it is possible to obtain the effect of causing the white color of clothes to be shown beautifully, and to improve luminous efficiency.

Generally, the threshold voltage (Vf) of the ultraviolet light LED chip has a voltage value higher than the threshold voltage of the blue LED chip. For example, the threshold voltage of the ultraviolet light LED chip may have a range formed by the minimum value of 3.1 V, the reference value of 3.4 V, and the maximum value of 3.7 V. On the contrary, the threshold voltage of the blue LED chip may have a range formed by the minimum value of 2.8 V, the reference value of 3.0 V, and the maximum value of 3.2 V.

A method in which a plurality of LED chips is connected in series to each other so as to form an LED string (LED series circuit) and a plurality of LED strings is connected in parallel to each other is used in order to obtain the sufficient quantity of light from the light emitting device using LED chips. Here, when each of the LED strings is configured only by the ultraviolet light LED chip or the blue LED chip, the synthetic threshold voltage of the LED string (summation value of the threshold voltages of LED chips connected in series to each other) has a voltage value which is different for each of the LED strings. Thus, since a current flowing in the LED string (LED string configured only by the blue LED chip) having a low synthetic threshold voltage is greater than a current flowing in the LED string (LED string configured only by the ultraviolet light LED chip) having a high synthetic threshold voltage, and light emitting intensity of one LED string is different from that of another LED string, there is a problem in that light emitting unevenness occurs between the LED strings. This problem is also similarly caused when the ultraviolet light LED chip is substituted with the violet LED chip.

In JP-A-2014-143307, only a technology in which a plurality of LED chips of any one type among the visible LED chip of colors and the ultraviolet light LED chip is connected in series and parallel to each other is disclosed, and a technology in which ultraviolet light LED chips and blue LED chips are mixed and connected in series and parallel to each other is not disclosed at all. In JP-A-2005-136006, only a technology in which the visible LED chips for the colors and the ultraviolet light LED chips are mixed is disclosed, and a specific connection structure of the LED chips is not disclosed at all.

SUMMARY

The present invention is made in order to solve the above problems, an object thereof is to provide a light emitting device which prevents the occurrence of light emitting unevenness when a plurality of an ultraviolet light LED chip or a violet LED chip and a blue LED chip is connected in series and parallel to each other.

As a result of the keen examination performed for the above object by the inventors, aspects of the present invention as follows are obtained.

According to a first aspect, there is provided a light emitting device including a plurality of LED strings connected in parallel, wherein: each of the LED strings includes a plurality of LED chips connected in series to each other; in the LED string, ultraviolet light LED chips and blue LED chips or violet LED chips and blue LED chips are connected in series to each other; and the number of the ultraviolet light LED chips or the number of the violet LED chips is the same as the number of the blue LED chips in each of the plurality of LED strings.

In the first aspect, since the synthetic threshold voltage of each of the LED strings (summation value of threshold voltages of LED chips connected in series to each other) has substantially the same voltage value for each of the LED strings, the current flowing in each of the LED strings has substantially the same current value and light emitting intensity for each of the LED strings is substantially the same. Thus, it is possible to prevent the occurrence of light emitting unevenness between the LED strings.

According to a second aspect, in the first aspect, the total number of the blue LED chips is equal to or greater than the total number of the ultraviolet light LED chips or the total number of the violet LED chips. In the second aspect, a plurality of blue LED chips having high luminous efficiency is included and thus it is possible to also improve luminous efficiency of the light emitting device. In the second aspect, the ultraviolet light LED chips or the violet LED chips are included and thus it is possible to obtain an effect of causing the white color of clothes to be shown beautifully. The number of synthesized LED chips may be set by experimentally obtaining an appropriate number.

According to a third aspect, in the first aspect or the second aspect, a board on which a plurality of LED chips is mounted is included. The ultraviolet light LED chips or the violet LED chips are dispersed and disposed on the board so as to face a light-reflecting surface. In the third aspect, since ultraviolet light emitted from the ultraviolet light LED chips or near-ultraviolet light emitted from the violet LED chips can be emitted equivalently from the light-reflecting surface, the effect of causing the white color of clothes to be shown more beautifully is reliably obtained.

According to a fourth aspect, in the third aspect, the blue LED chips are disposed so as to surround the ultraviolet light LED chips and the violet LED chips. According to the fourth aspect, the action and the effect of the third aspect is reliably obtained.

According to a fifth aspect, in the third aspect or the fourth aspect, the ultraviolet light LED chips or the violet LED chips are point-symmetrically disposed based on a center point of the light-reflecting surface. According to the fifth aspect, the action and the effect of the third aspect is further reliably obtained.

According to a sixth aspect, in the fifth aspect, LED chips of an even number are connected in series to each other in each of the plurality of LED strings. According to the sixth aspect, in the fifth aspect, point symmetrical disposition of the ultraviolet light LED chips or the violet LED chips can be easily realized.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Figure 1:
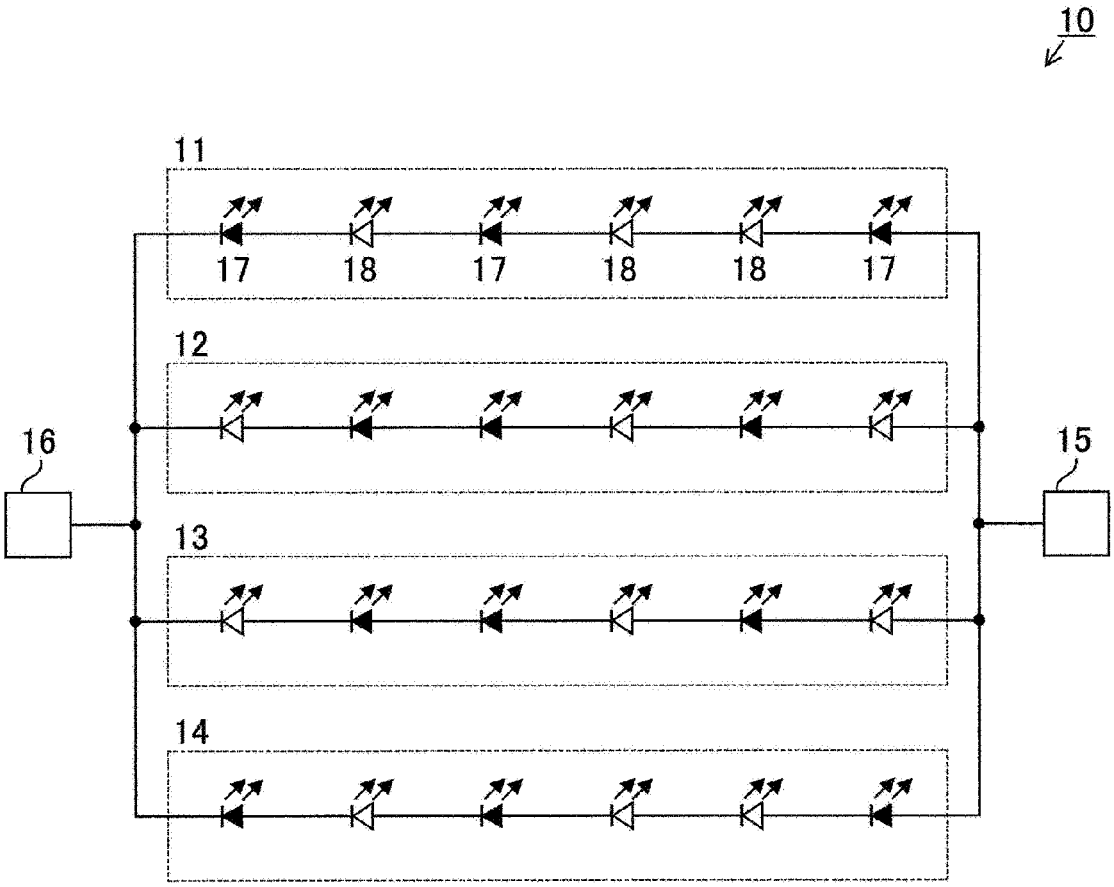
FIG. 1 is a circuit diagram of a light emitting device 10 according to a first embodiment obtained by embodying the present invention.

Hereinafter, embodiments obtained by embodying the present invention will be described with reference to the drawings. In the embodiments, the same component members and constituents are denoted by the same reference numerals and repetitive descriptions for parts having the same details will be omitted. In the drawings, for easily understandable descriptions, dimensions, shapes, and disposition places of component members are schematically illustrated with exaggeration and the dimensions, shapes, and disposition places of the illustrated components may not necessarily match those of the realized components.

<First Embodiment>

As illustrated in FIG. 1, regarding a circuit configuration of a light emitting device 10 according to a first embodiment, four LED strings (LED series circuit) 11 to 14 are connected in parallel to each other between an anode electrode (positive side electrode) 15 and a cathode electrode (negative side electrode) 16. Regarding a circuit configuration of each of the LED strings 11 to 14, three ultraviolet light LED chips 17 and three blue LED chips 18 are connected in series to each other. That is, in the light emitting device 10, the four LED strings 11 to 14 in which the three ultraviolet light LED chips 17 and the three blue LED chips 18 are connected in series to each other are connected in parallel to each other. This means that 12 ultraviolet light LED chips 17 and 12 blue LED chips 18 are connected in series and parallel to each other.

In FIG. 1, connecting places of the LED chips 17 and 18 in the LED strings 11 and 14, and the LED strings 12 and 13 are different from each other. The connecting place of the LED chips 17 and 18 in FIG. 1 corresponds to a disposing place of the LED chips 17 and 18 in a plan view of the light emitting device 10 illustrated in FIG. 2.

Figure 2:
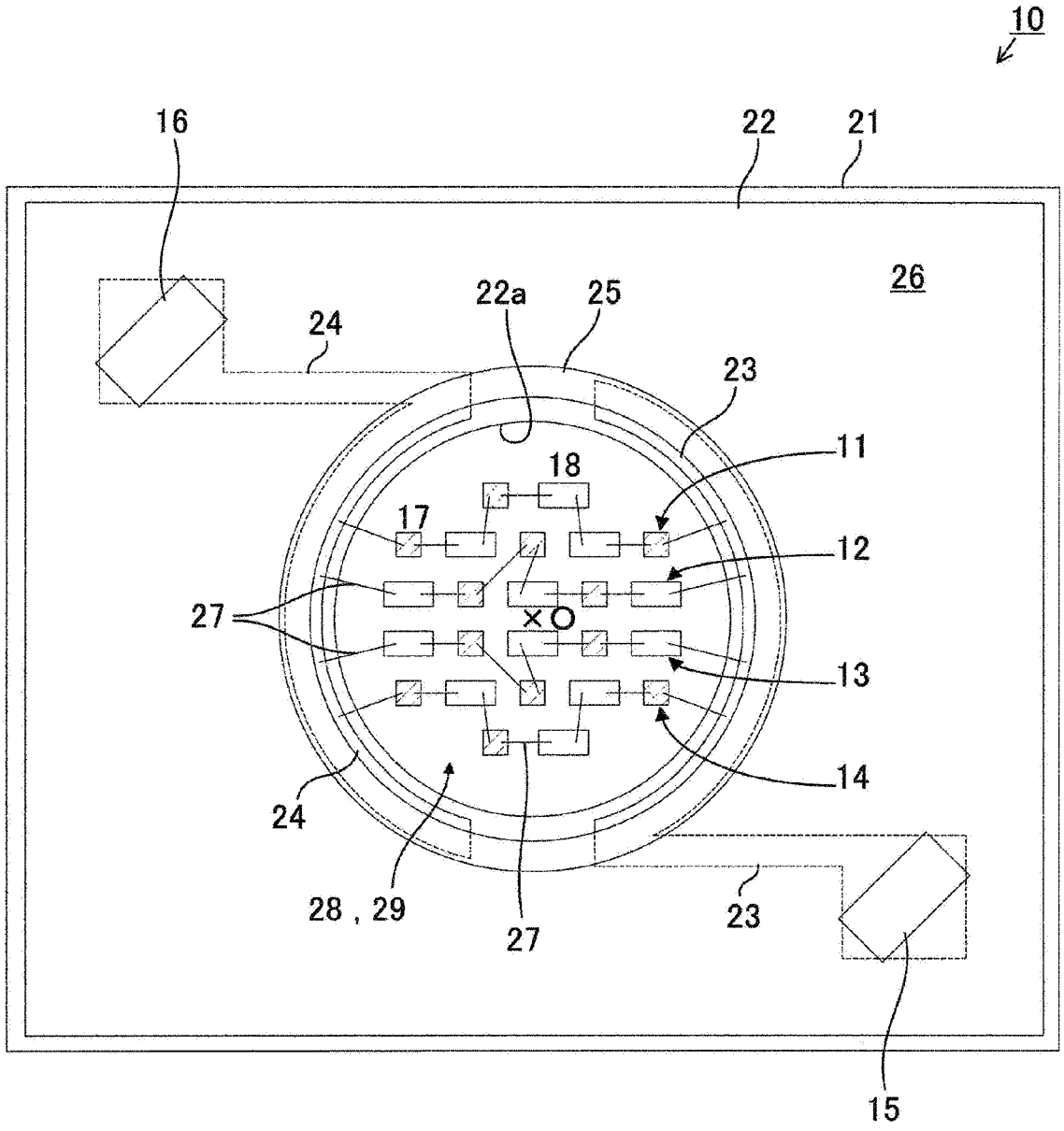
FIG. 2 is a plan view illustrating a schematic configuration of the light emitting device 10.

As illustrated in FIG. 2, the light emitting device 10 includes a heat dissipation board 21, a wiring board 22 (through-hole 22*a*), wiring layers 23 and 24, a frame member 25, an insulating layer 26, a bonding wire 27, a sealing member 28, a light-reflecting surface 29 (center point O), and the like in addition to the LED strings 11 to 14, the anode electrode 15, the cathode electrode 16, the ultraviolet light LED chip 17, and the blue LED chip 18.

The heat dissipative board (support member, and base) 21 is formed by a rectangular flat plate member. The rectangular flat plate member is formed of a metallic material (for example, aluminium alloys, pure steel, copper alloys, and the like of which high reflection treatment is performed on a surface) which has high thermal conductivity and high optical reflectance. The material of the heat dissipative board 21 is not limited to the metallic material and the heat dissipative board 11 may be formed of any material having high thermal conductivity and high optical reflectance (for example, a synthetic resin material, a ceramics material, and the like).

The wiring board (wiring plate, insulating plate, and insulating layer) 22 adheres and is fixed to the front surface of the heat dissipative board 21. A through-hole 22*a* is formed in the wiring board 22. The wiring board 22 is formed, for example, by a composite board of a synthetic resin material (for example, epoxy resin, phenol resin, and the like) and a base material (for example, glass fiber, paper, and the like), and a rectangular flat plate member formed of a ceramics material (for example, aluminium nitride, and the like). The composite board has high insulating properties and is, for example, a glass-epoxy board, a paper-phenol board, and the like.

Each of the LED chips 17 and 18 is a bare chip formed so as to have a substantially rectangular parallelepiped shape. The LED chips 17 and 18 are mounted and loaded on the front surface of the heat dissipative board 21, which is exposed through the through-hole 22*a*, by using a chip-on-board (COB) method. The wiring layers 23 and 24 are formed of copper foils and are formed on the front surface (surface on an opposite side of a surface which adheres and is fixed to the heat dissipative board 21) of the wiring board 22.

The circular frame member (dam member) 25 is arranged on the front surface of the wiring board 22 so as to surround the through-hole 22*a* of the wiring board 22. The frame member 25 is formed, for example, by a white synthetic resin material (for example, silicone resin, epoxy resin, phenol resin, and the like), a ceramics material (for example, aluminium oxide and the like) having high optical reflectance, or a metallic material (for example, aluminium alloys and the like) having high optical reflectance. In the synthetic resin material, minute particles (for example, titanium oxide, aluminium oxide, boron nitride, aluminium nitride, barium sulfate, and the like) having high optical reflectance are dispersed and disposed.

The insulating layer 26 is formed of a synthetic resin material having insulating properties and is formed at an outer side portion of the frame member 25 on the front surface of the wiring board 22. Portions of the wiring layers 23 and 24, which are formed on an outside of the frame member 25 are exposed from the insulating layer 26. An anode electrode 15 is formed by the wiring layer 23 exposed from the insulating layer 26, and a cathode electrode 16 of the light emitting device 10 is formed by the wiring layer 24 exposed from the insulating layer 26. Portions of the wiring layers 23 and 24 are exposed from the inside of the frame member 25. The bonding wire 27 is formed from a metal wire having high conductivity. The bonding wire 27 causes the LED chips 17 and 18 to be connected in series to each other and is connected to the wiring layers 23 and 24 which are exposed from the inside of the frame member 25. The LED strings 11 to 14 are connected to each other between the wiring layers 23 and 24, which are exposed from the inside of the frame member 25, through bonding layers 27.

The sealing member 28 is injected into the frame member 25 and the frame member 25 is filled with the sealing member 28. Each of the LED chips 17 and 18 and each of the bonding wires 27 are buried in the sealing member 28 by sealing of the sealing member 28. The sealing member 28 is formed by a transparent synthetic resin material (for example, silicone resin and the like) which contains phosphors (for example, YAG (Yttrium Aluminum Garnet) and the like). The front surface of the sealing member 28 is set as a light-reflecting surface (light-radiating area, light-emitting area, light-emitting portion) 29 of the light emitting device 10. Since the light-reflecting surface 29 has a substantially circular shape, the center point of the substantially circular shape is set as the center point 0 of the light-reflecting surface 29.

In the light emitting device 10, primary light (blue light) emitted from the blue LED chips 18 and secondary light (yellow light) are color-mixed. The secondary light has a wavelength converted by a portion of the primary light exciting the phosphors contained in the sealing member 28. White light generated by color-mixing is emitted from the front surface of the sealing member 28, which is the light-reflecting surface 29. Ultraviolet light which has been emitted from the ultraviolet light LED chips 17 is emitted from the front surface of the light-reflecting surface 29. For this reason, according to the light emitting device 10, it is possible to obtain the effect of causing the white color of clothes to be shown beautifully by using the ultraviolet light LED chips 17. In addition, it is possible to improve luminous efficiency by using the blue LED chips 18.

[Actions and Advantages of First Embodiment]

According to the light emitting device 10 of the first embodiment, it is possible to obtain the following actions and advantages.

[1] In the light emitting device 10, the number (three) of the ultraviolet light LED chips 17 is the same as the number (three) of the blue LED chips 18 in each of the LED strings 11 to 14. Thus, the synthetic threshold voltage of the LED string (summation value of the threshold voltages of the LED chips 17 and 18 which are connected in series to each other) is substantially the same voltage value in the LED strings 11 to 14. For this reason, in the light emitting device 10, currents flowing in the LED strings 11 to 14 also have substantially the same current value and light emitting intensity of the LED strings 11 to 14 is substantially the same. Accordingly, it is possible to prevent the occurrence of light emitting unevenness between the LED strings 11 to 14.

[2] In the light emitting device 10, the total number (12) of the blue LED chips 18 is the same as the total number (12) of the ultraviolet light LED chips 17. For this reason, many blue LED chips 18 having high luminous efficiency are included and thus it is possible to improve luminous efficiency of the light emitting device 10. The light emitting device 10 includes the ultraviolet light LED chips 17 and thus it is possible to obtain the effect of causing the white color of the clothes to be shown more beautifully. The number of synthesized LED chips 17 and 18 may be set by experimentally obtaining an appropriate number.

[3] In the light emitting device 10, since the ultraviolet light LED chips 17 are dispersed and disposed on the light-reflecting surface 29, ultraviolet light which has been emitted from the ultraviolet light LED chips 17 can be emitted equivalently from the light-reflecting surface 29 and it is possible to reliably obtain the effect of causing the white color of the clothes to be shown more beautifully.

[4] In the light emitting device 10, since the ultraviolet light LED chips 17 in the LED strings 12 and 13 are disposed so as to be surrounded by the blue LED chips 18 in the LED strings 11 and 14, the action and the effect of [3] are reliably obtained.

[5] In the light emitting device 10, since the ultraviolet light LED chips 17 are point-symmetrically disposed based on the center point O of the light-reflecting surface 29, the action and the effect of [3] are more reliably obtained.

[6] Since the LED chips 17 and 18 of six (even number) are connected in series to each other in the LED strings 11 and 14, it is possible to easily realize point-symmetrical disposition of the ultraviolet light LED chips 17 in [5].

<Second Embodiment>

Figure 3:
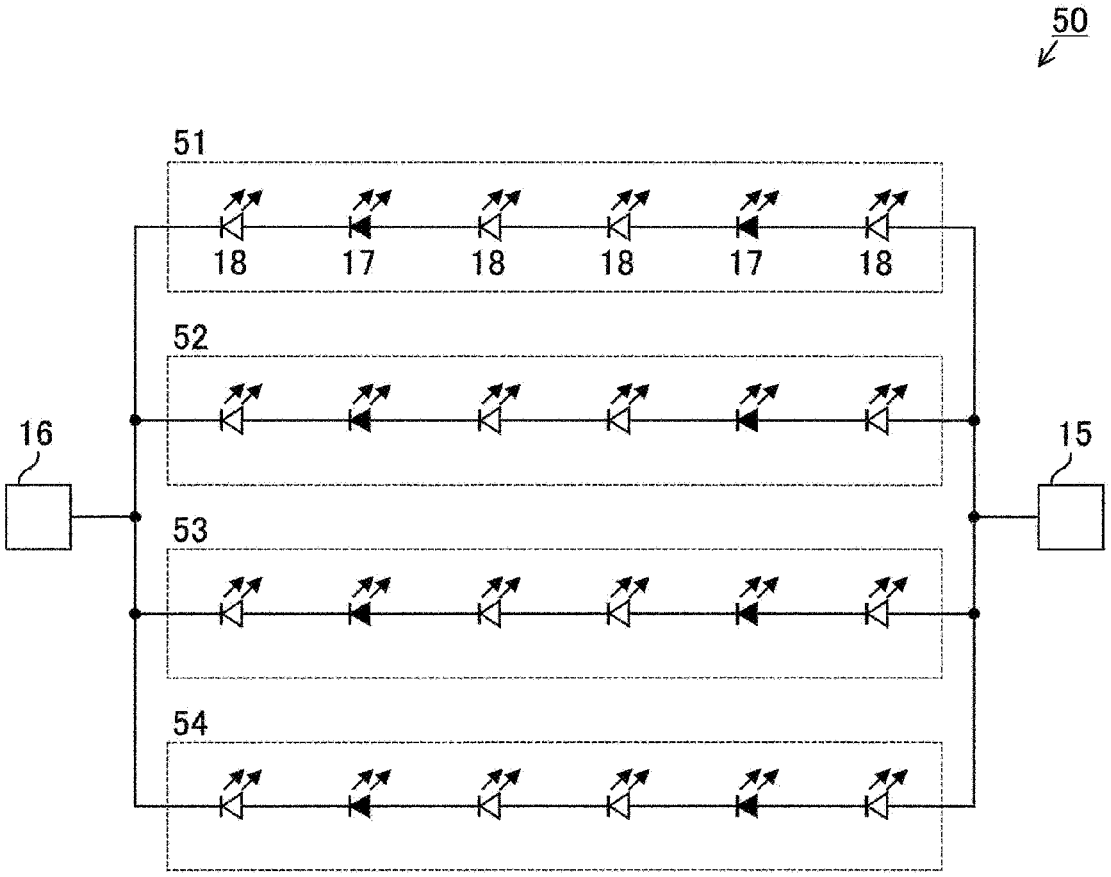
FIG. 3 is a circuit diagram of a light emitting device 50 according to a second embodiment obtained by embodying the present invention.

As illustrated in FIG. 3, regarding a circuit configuration of a light emitting device 50 according to a second embodiment, four LED strings 51 to 54 are connected in parallel to each other between the anode electrode 15 and the cathode electrode 16. Regarding a circuit configuration of each of the LED strings 51 to 54, two ultraviolet light LED chips 17 and four blue LED chips 18 are connected in series to each other.

That is, in the light emitting device 50, the four LED strings 51 to 54 in which the two ultraviolet light LED chips 17 and the four blue LED chips 18 are connected in series to each other are connected in parallel to each other. This means that 16 ultraviolet light LED chips 17 and 8 blue LED chips 18 are connected in series and parallel to each other. Connecting places of the LED chips 17 and 18 in FIG. 3 correspond to disposing places of the LED chips 17 and 18 in a plan view of the light emitting device 50 illustrated in FIG. 4.

Figure 4:
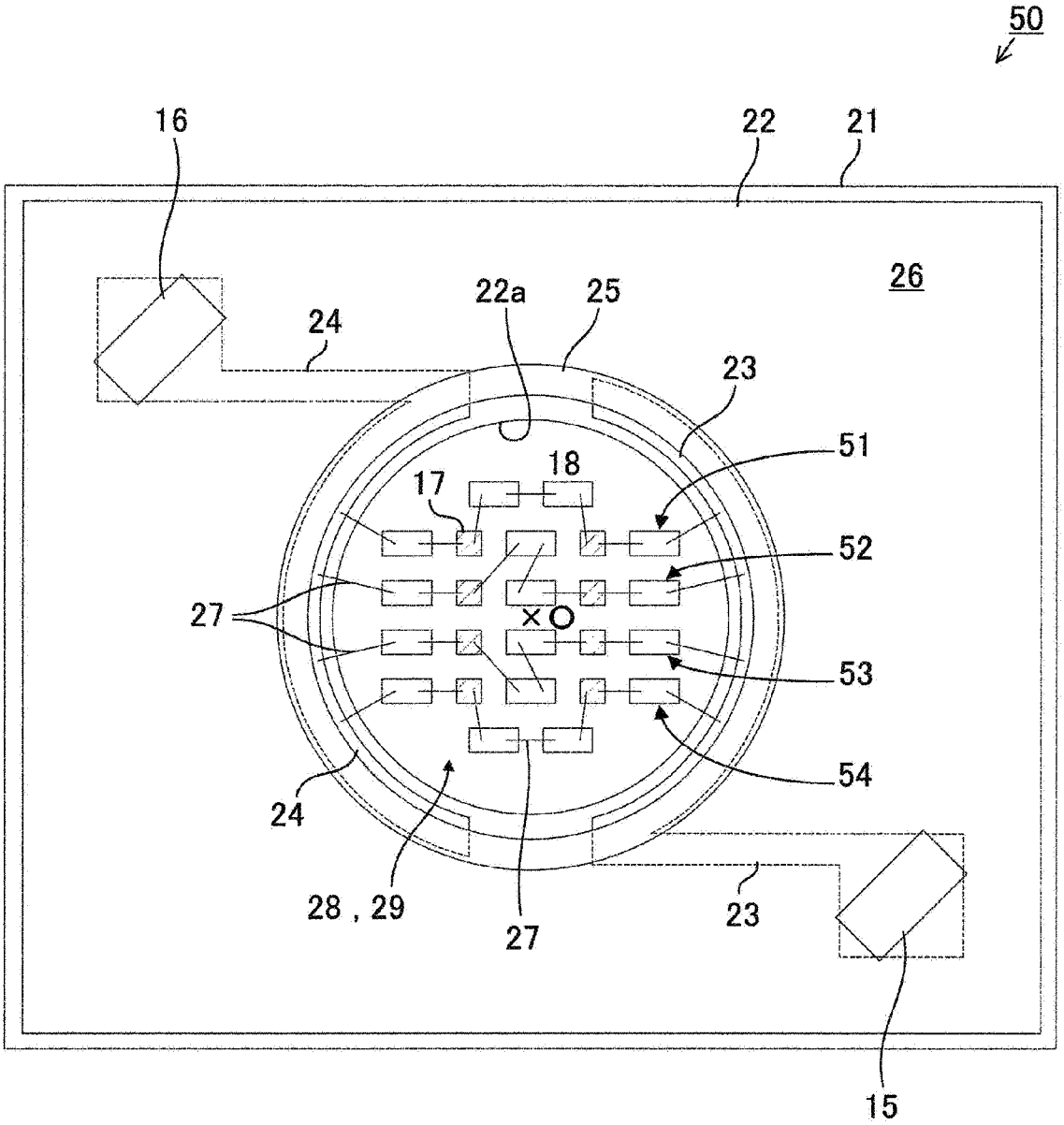
FIG. 4 is a plan view illustrating a schematic configuration of the light emitting device 50.

As illustrated in FIG. 4, the light emitting device 50 includes the heat dissipation board 21, the wiring board 22 (through-hole 22*a*), the wiring layers 23 and 24, the frame member 25, the insulating layer 26, the bonding wires 27, the sealing member 28, the light-reflecting surface 29, and the like in addition to the LED strings 51 to 54, the anode electrode 15, the cathode electrode 16, the ultraviolet light LED chips 17, and the blue LED chips 18. The LED strings 51 to 54 are connected to each other between the wiring layers 23 and 24 which are exposed from the outside of the frame member 25, through the bonding wires 27.

[Actions and Advantages of Second Embodiment]

According to the light emitting device 50 of the second embodiment, it is possible to obtain actions and advantages similar to those in the first embodiment.

In the light emitting device 50, the total number (16) of the blue LED chips 18 is greater than the total number (8) of the ultraviolet light LED chips 17. For this reason, in the light emitting device 50 according to the second embodiment, it is possible to improve luminous efficiency in comparison to the light emitting device 10 according to the first embodiment.

In the light emitting device 50, since the ultraviolet light LED chips 17 in the LED strings 11 to 14 are disposed so as to be surrounded by the blue LED chips 18 in the LED strings 11 to 14, the action and the effect of [3] in the first embodiment are reliably obtained.

<Other Embodiments>

The present invention is not limited to the above-described embodiments and may be embodied as follows. In this case, it is also possible to obtain actions and effects which are similar to those in the above-described embodiments or are improved.

[A] The ultraviolet light LED chip 17 may be substituted with a violet LED chip which emits violet light in addition to near-ultraviolet light.

[8] The number of the ultraviolet light LED chips 17 and the blue LED chips 18 constituting each of the LED strings may be appropriately set. The number of LED strings which are connected in parallel to each other may also be appropriately set.

[C] The heat dissipation board 21 may be omitted, and the LED chips 17 and 18 may be mounted and loaded on the wiring board 22.

[D] The bonding wires 27 may be omitted, and the LED chips 17 and 18 and the wiring layers 23 and 24 may be connected by flip-chip bonding.

The present invention is not limited to the aspects and the descriptions of the embodiment. The present invention includes various modifications within a scope which can be easily derived by the inventors without departing from the descriptions of the claims. Details of the patent documents and the like mentioned in this specification are cited by incorporating the entirety of the details.

What is claimed is:

1. A light emitting device comprising:

a plurality of light emitting diode (LED) strings connected in parallel; and a sealing member formed on the plurality of LED strings and comprising a light-reflecting surface having a substantially circular shape, wherein:

each of the LED strings includes a plurality of LED chips connected in series to each other;

in the LED string, ultraviolet light LED chips and blue LED chips or violet LED chips and blue LED chips are connected in series to each other;

a number of the ultraviolet light LED chips or a number of the violet LED chips is the same as a number of the blue LED chips in each of the plurality of LED strings;

the light emitting device further comprises a board on which the plurality of LED chips is mounted;

the ultraviolet light LED chips or the violet LED chips are dispersed and disposed on the board so as to face the light-reflecting surface;

the plurality of LED chips have a non-linear arrangement in the LED strings such that an LED chip in an LED string of the plurality of LED strings is aligned with LED chips in another LED string of the plurality of LED strings, the blue LED chips are disposed so as to surround the ultraviolet light LED chips or the violet LED chips, and the ultraviolet light LED chips or the violet LED chips are point-symmetrically disposed based on a center point of the light-reflecting surface.

2. The light emitting device according to claim 1, wherein a total number of the blue LED chips is equal to or greater than a total number of the ultraviolet light LED chips or a total number of the violet LED chips.

3. The light emitting device according to claim 1, wherein

LED chips of an even number are connected in series to each other in each of the plurality of LED strings.

4. The light emitting device according to claim 3, wherein a total number of the blue LED chips is equal to or greater than a total number of the ultraviolet light LED chips or a total number of the violet LED chips.

5. A light emitting device comprising a plurality of LED strings connected in parallel; and a sealing member formed on the plurality of LED strings and comprising a light-reflecting surface having a substantially circular shape, wherein:

each of the LED strings includes a plurality of LED chips connected in series to each other;

in the LED string, ultraviolet light LED chips and blue LED chips or violet LED chips and blue LED chips are connected in series to each other;

a number of the ultraviolet light LED chips or a number of the violet LED chips is the same as a number of the blue LED chips in each of the plurality of LED strings;

the light emitting device further comprises a board on which the plurality of LED chips is mounted;

the ultraviolet light LED chips or the violet LED chips are dispersed and disposed on the board so as to face the light-reflecting surface;

the ultraviolet light LED chips or the violet LED chips are point-symmetrically disposed based on a center point of the light-reflecting surface, and the plurality of LED chips have a non-linear arrangement in the LED strings such that an LED chip in an LED string of the plurality of LED strings is aligned with LED chips in another LED string of the plurality of LED strings.

6. The light emitting device according to claim 5, wherein the blue LED chips are disposed so as to surround the ultraviolet light LED chips or the violet LED chips.

7. The light emitting device according to claim 5, wherein

LED chips of an even number are connected in series to each other in each of the plurality of LED strings.

8. The light emitting device according to claim 6, wherein

LED chips of an even number are connected in series to each other in each of the plurality of LED strings.

9. The light emitting device according to claim 5, wherein a total number of the blue LED chips is equal to or greater than a total number of the ultraviolet light LED chips or a total number of the violet LED chips.

10. The light emitting device according to claim 6, wherein a total number of the blue LED chips is equal to or greater than a total number of the ultraviolet light LED chips or a total number of the violet LED chips.

11. The light emitting device according to claim 7, wherein a total number of the blue LED chips is equal to or greater than a total number of the ultraviolet light LED chips or a total number of the violet LED chips.

12. The light emitting device according to claim 8, wherein a total number of the blue LED chips is equal to or greater than a total number of the ultraviolet light LED chips or a total number of the violet LED chips.

13. A light emitting device comprising a plurality of light emitting diode (LED) strings connected in parallel, each of the LED strings including a plurality of LED chips connected in series to each other, the plurality of LED chips comprising:

blue LED chips; and other LED chips comprising one of ultraviolet light LED chips and violet LED chips, a number of other LED chips being the same as a number of the blue LED chips in each of the plurality of LED strings, and the plurality of LED chips have a non-linear arrangement in the LED strings and the blue LED chips surround the other LED chips in a plan view such that an LED chip in an LED string of the plurality of LED strings is aligned with LED chips in another LED string of the plurality of LED strings;

a sealing member formed on the plurality of LED strings and comprising a light-reflecting surface having a substantially circular shape; and a board on which the plurality of LED chips is mounted, the other LED chips being dispersed and disposed on the board so as to face the light-reflecting surface, wherein the other LED chips are point-symmetrically disposed based on a center point of the light-reflecting surface.

14. The light emitting device of claim 13, further comprising:

a frame member formed on the board, wherein the sealing member is formed in the frame member and the plurality of LED chips are buried in the sealing member and sealed by the sealing member.

15. The light emitting device according to claim 1, wherein the sealing member comprises a resin material including a phosphor, and the light-reflecting surface comprises a light-emitting portion of the light emitting device.

16. The light emitting device according to claim 15, wherein the phosphor converts a portion of the blue light from the blue LED chips to yellow light, and the light-reflecting surface emits:

white light generated by color-mixing of the blue light and the yellow light in the sealing member; and ultraviolet light from the ultraviolet light LED chips, or violet light emitted from the violet light LED chips.

* * * * *